US009938732B1

(12) United States Patent
Hay, Jr.

(10) Patent No.: US 9,938,732 B1
(45) Date of Patent: Apr. 10, 2018

(54) ARTICULATING STAGING SYSTEM FOR MANUFACTURING

(71) Applicant: Thomas Michael Hay, Jr., New Smyrna Beach, FL (US)

(72) Inventor: Thomas Michael Hay, Jr., New Smyrna Beach, FL (US)

(73) Assignee: Boston Whaler, Inc., Edgewater, FL (US)

( * ) Notice: Subject to any disclaimer, the term of this patent is extended or adjusted under 35 U.S.C. 154(b) by 114 days.

(21) Appl. No.: 14/656,249

(22) Filed: Mar. 12, 2015

(51) Int. Cl.
*E04G 1/24* (2006.01)

(52) U.S. Cl.
CPC ..... *E04G 1/24* (2013.01)

(58) Field of Classification Search
CPC ..... E04G 1/24
USPC ..... 182/223, 182.3; 193/22; 198/339.1
See application file for complete search history.

(56) References Cited

U.S. PATENT DOCUMENTS 590,147 A * 9/1897 Guastavino ..... B63B 9/00 114/46
657,660 A * 9/1900 Jamieson ..... B63B 9/00 114/46
2,623,643 A * 12/1952 Seamans ..... E04G 5/06 182/128
3,265,156 A * 8/1966 Jacobs ..... E04H 3/16 182/113
3,395,648 A * 8/1968 Karr ..... B66B 21/10 198/321
3,908,793 A * 9/1975 Vaughn ..... E04G 5/04 182/152
4,082,161 A * 4/1978 Johnson ..... E04G 3/30 182/142
4,919,230 A * 4/1990 Langer ..... E04G 1/15 182/186.8
5,042,648 A * 8/1991 Garvey ..... B65G 17/066 198/321
5,201,407 A * 4/1993 Proske ..... B65G 23/14 198/833
6,044,961 A * 4/2000 Hine ..... B65G 17/08 198/502.1

(Continued)

FOREIGN PATENT DOCUMENTS

DE 4017513 12/1991

*Primary Examiner* — Katherine W Mitchell
*Assistant Examiner* — Shiref M Mekhaeil
(74) *Attorney, Agent, or Firm* — Malin Haley Dimaggio & Bowen, P.A.

(57) ABSTRACT

A articulating staging system includes a series of interconnected stage links each having a platform and a support frame. A fixed central stage link is provided to which intermediate stage links are attached. Additional intermediate stage links may be attached to adjacent intermediate stage links. End stage links may attach to adjacent stage links to provide an access point. The intermediate and end stage links articulate about one another and the central stage link to position and reposition the system around a structure for repair, assembly, and maintenance work. The central stage link has opposing concave ends to which convex ends of the intermediate stage links interface. The intermediate stage links have a concave end to which an adjacent intermediate stage link interfaces. The end stage link interfaces similarly. The stage links interface by way of the support frames which interconnected underneath the platforms of the stage links.

17 Claims, 8 Drawing Sheets

(56) References Cited

U.S. PATENT DOCUMENTS

| | | | | |
|---|---|---|---|---|
| 6,186,314 | B1 * | 2/2001 | Conklin, Jr. | B65G 17/00 198/502.1 |
| 6,758,328 | B2 * | 7/2004 | Arai | B65G 17/086 198/844.1 |
| 6,981,584 | B2 * | 1/2006 | Grabmann | B65G 17/065 198/850 |
| 7,740,107 | B2 * | 6/2010 | Lemburg | E04G 3/30 182/142 |
| 9,394,021 | B2 * | 7/2016 | Okazaki | B62D 65/18 |
| 9,394,112 | B2 * | 7/2016 | Andreoli | B65G 17/086 |
| 2006/0157320 | A1 * | 7/2006 | Spoeler | B62D 65/18 198/463.1 |
| 2008/0302605 | A1 * | 12/2008 | St-Germain | E04G 1/20 182/223 |
| 2010/0213035 | A1 * | 8/2010 | Drago | B65G 25/065 198/750.2 |
| 2012/0181144 | A1 * | 7/2012 | Turek | B66B 21/10 198/330 |

* cited by examiner

ARTICULATING STAGING SYSTEM FOR MANUFACTURING

CROSS REFERENCE TO RELATED APPLICATIONS

N/A

STATEMENT REGARDING FEDERALLY SPONSORED RESEARCH OR DEVELOPMENT

N/A

DETAILED DESCRIPTION

Figure 1:
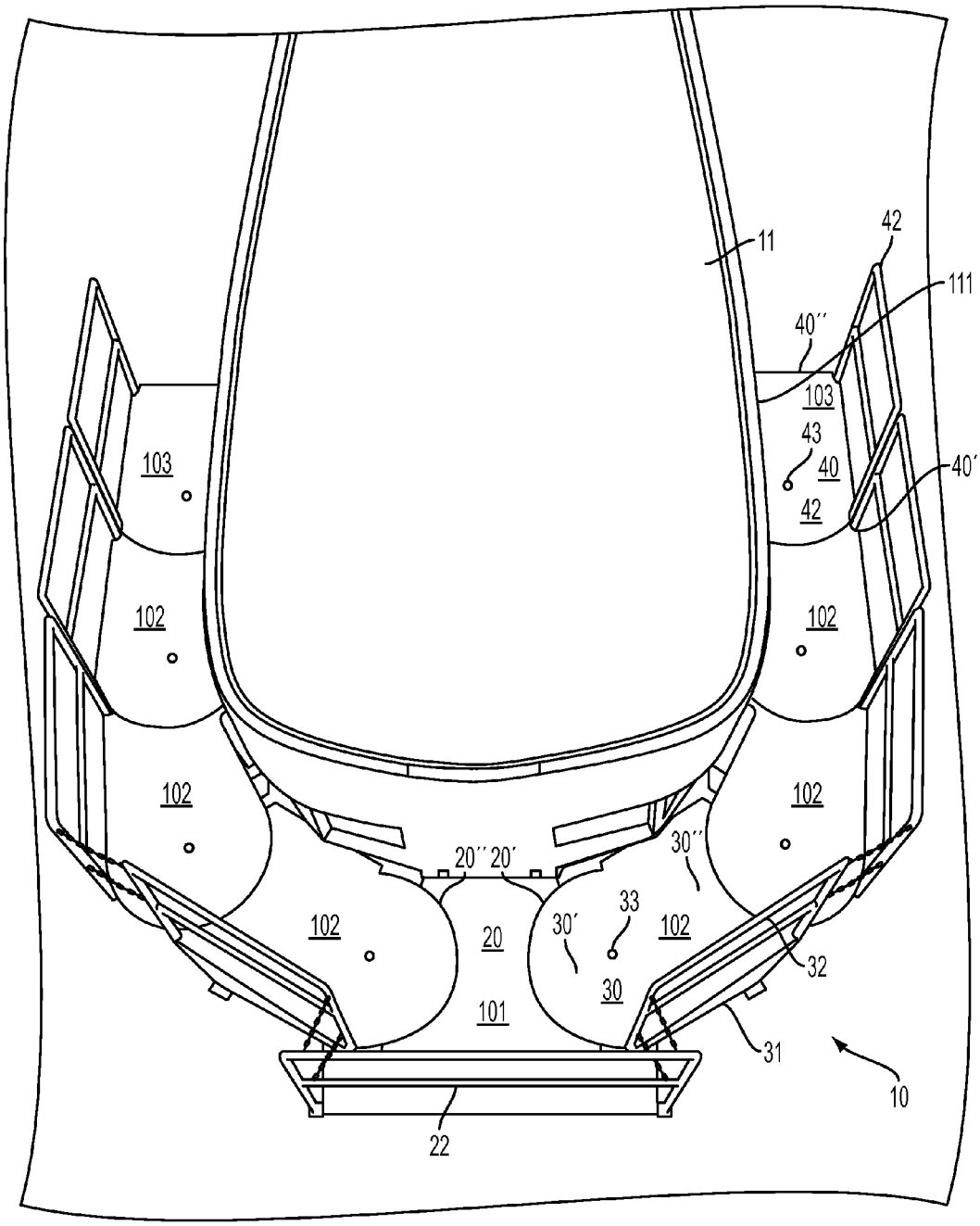
FIG. 1 is a top perspective view of one embodiment of the staging system of the present invention.

Shown in FIG. 1 is a top perspective view of one embodiment of the staging system 10 of the present invention. The system 10 comprises a plurality of stage links 101, 102, and 103 that can be assembled around a given structure 11 in adjoining fashion to form a working platform surface to provide access to the structure 11 and a stable platform to carry out assembly and manufacturing tasks with respect to structure 11. In an exemplary embodiment, structure 11 comprises a marine vessel. As will be apparent from this disclosure, the stage links of the staging system 10 are each configured to interface with one another and articulate such that the staging system 10 can conform closely to the shape of a given structure 11 to provide a safe and stable working platform or building, assembly, and repair work.

In some embodiments, the staging system 10 is centered by a center link 101 that includes a platform 20 supported by a support frame 21, and an upper safety rail 22. The platform 20 of the center link 101 includes two laterally opposing concave ends 20' and 20". Each of the concave ends are configured to interface with an adjacent stage link such as, for example, intermediate stage link 102 as shown in FIG. 1. Intermediate stage link 102 comprises a platform 30 supported by a support frame 31, and an upper safety rail 32. The platform 30 includes a convex end 30' and an opposing concave end 30". Toward the convex end 30' is a rotation axis 33. In some embodiments, the rotation axis 33 is located at the radial center of the curve defined by the convex end 30'. From FIG. 1 it can be seen a series of intermediate stage links 102 are provided to in adjoining fashion to form staging system 10. For example, an intermediate stage link 102 is provided at the opposing ends 20' and 20" of center link 101 such that each concave end 30' interfaces with the concave ends 20' and 20" in articulating fashion.

In some embodiments, provided is an end stage link 103 which includes a platform 40 supported by a support frame 41 and an upper safety rail 42. The platform 40 of the end stage link 103 includes a convex end 40' and opposing straight end 40". Toward the convex end 40' is a rotation axis 43. In some embodiments, the rotation axis 43 is located at the radial center of the curve defined by the convex end 40'. In FIG. 1 it can be seen how the convex end 40' of end stage link 103 adjoins and interfaces with the concave end 30" of intermediate stage link 102 in articulating fashion. Additionally it can be seen that straight end 40" of end stage link 103 can provide an access point to the staging system 10 such as for example by staircase or other access means.

Figure 2:
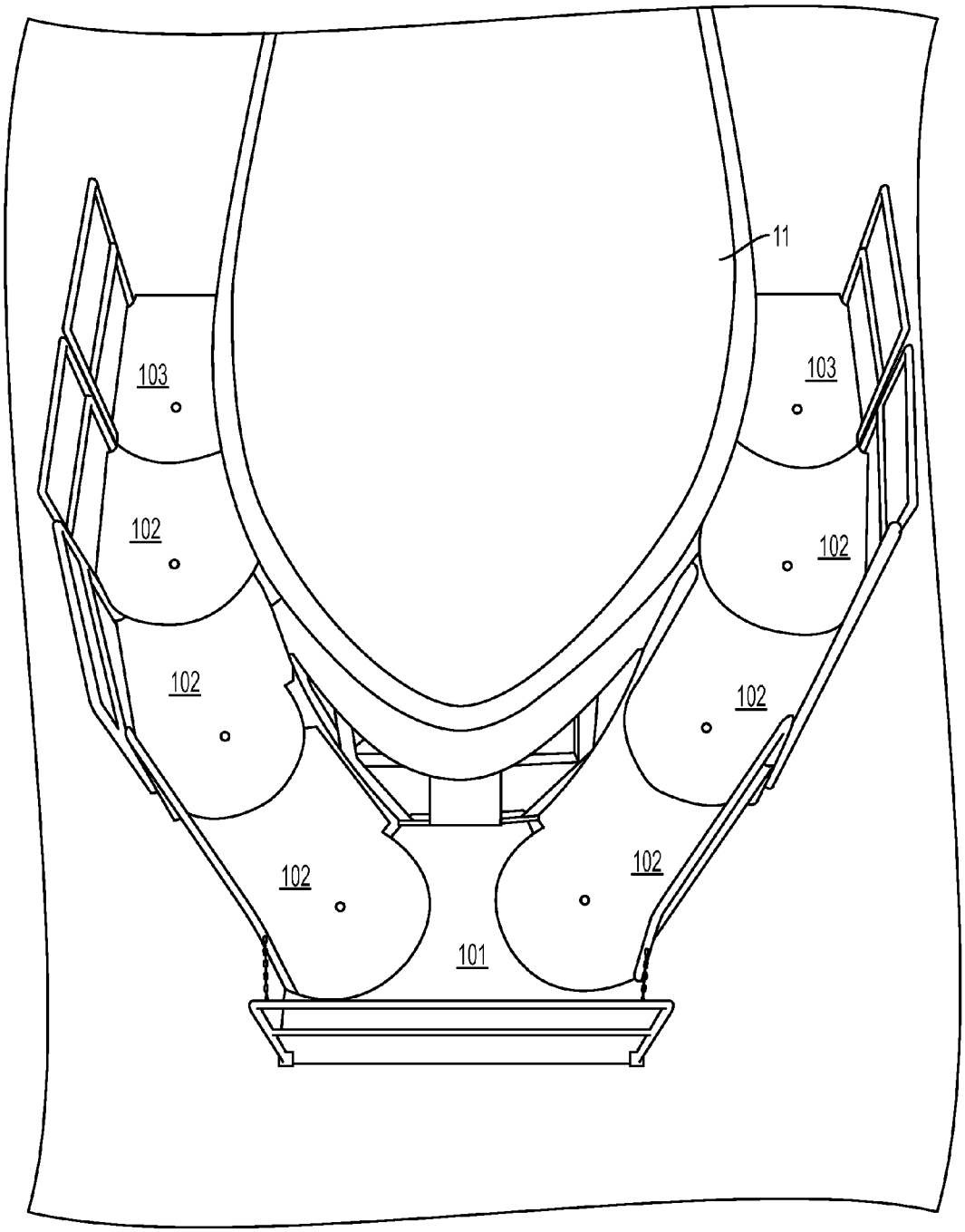
FIG. 2 is an alternative top perspective view of one embodiment of the staging system of the present invention.

FIG. 2 depicts another embodiment of the staging system 10 shown in use around an exemplary structure 11 having a somewhat different shape than the structure 11 shown in FIG. 1. From here it can be seen how intermediate and end stage links 102 and 103 articulate with respect to one another and center stage link 101 to conform to the given shape of a structure 11. The articulating nature of the stage links 102 and 103 provide for a staging system 10 that can accommodate multiple curves and angles corresponding to the varying shapes of different structures 11. For example, in the case where structure 11 is a marine vessel such exemplary vessels may have different shaped bows and stern. In some cases, the bow of the vessels vary in shape from very blunt and almost square to very acute point angles. Additionally the stern of such vessels may vary from wide and straight to rounded and narrow. Accordingly, this staging system 10 utilizes multiple stage links which articulate with respect to one another to conform around the different aspects of the structure 11 without leaving any gaps or trip hazards. As such, it is evident that the staging system 10 can be positioned to conform to the shapes of various structures including various marine vessels and other structures to provide a stable and safe means by which to access the structure 11 to carry out building operations, repairs, assembly, and other tasks.

Figure 3:
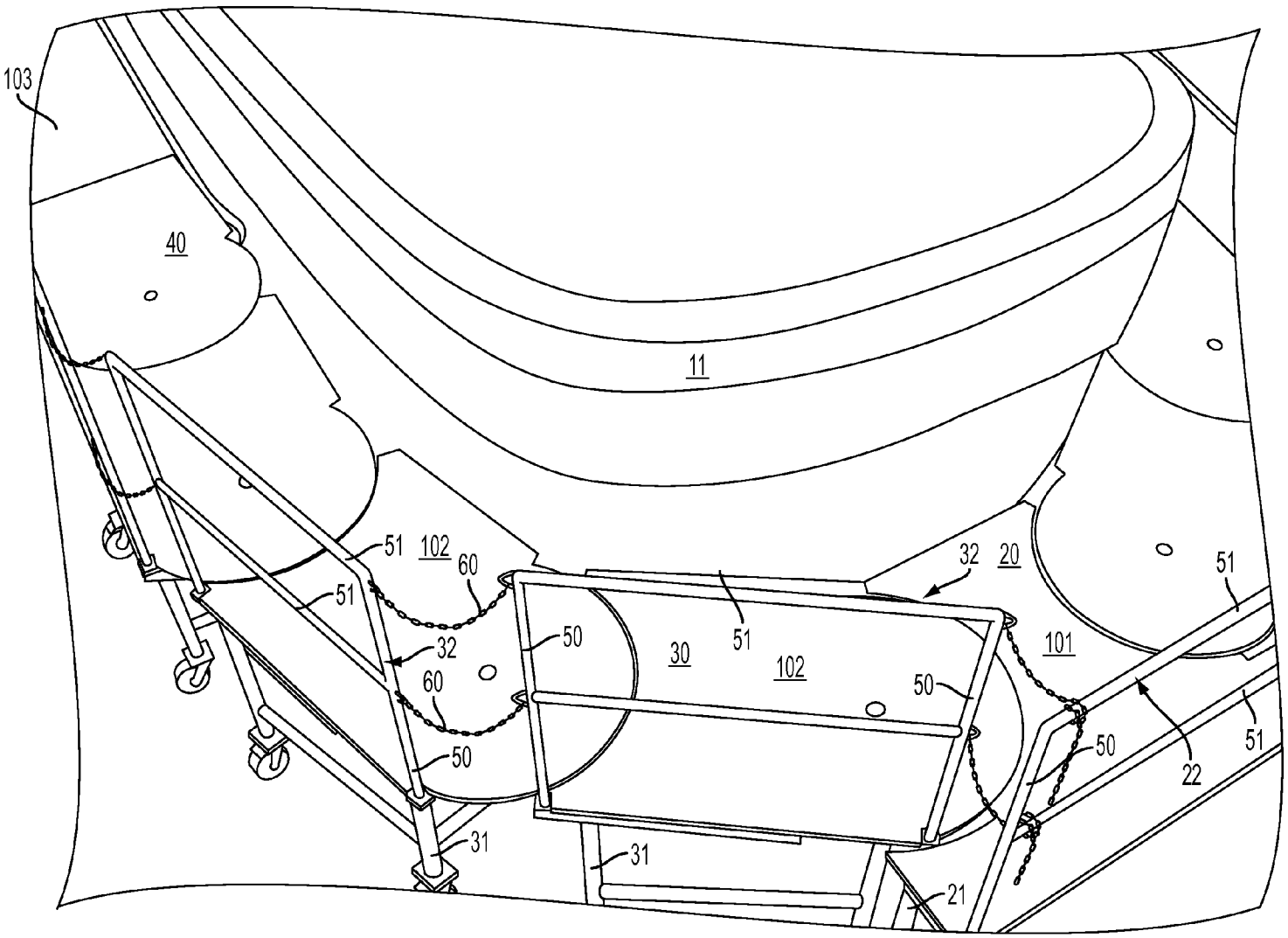
FIG. 3 as a side perspective view of one embodiment of the staging system of the present invention.

FIG. 3 is a side perspective view of an embodiment of staging system 10 of the present invention. Here it can be seen that the respective platforms 20, 30 and 40 of the stage links 101, 102, and 103 are supported by the respective support frames 21, 31, and 41 thereof. Also shown are the safety rails of the stage links 101 and 102 (stage link 103 partially obscured). In some embodiments each stage link 101, 102, and 103 includes a safety rail 22, 32, and 42 respectively to ensure that workers can safely access and move about the staging system 10. In some embodiments the safety rails 22, 32, and 42 each comprise a plurality of rail legs 50 connected by transversely disposed rail members 51. In some embodiments, the safety rails 22, 32, and 42 are removably attached to the respective support frame 21, 31, and 32 of the stage links 101, 102, 103. Further in some embodiments, the legs 50 of the safety rails 22, 32, and 42 are telescopically engaged with the respective support frames 21, 31 and 41. A male-female engagement between the safety rails and the support frames may be provided to facilitate telescopic movement of the safety rails with respect to the support frames. This allows for vertical adjustment of the safety rails as desired. Further still, in some embodiments, adjacent safety rails may be secured to one another by a one or more ties 60 which may comprise a chain-link or rope element. FIG. 3 also shows a close-up of the manner by which system 10 through the assembled combination of articulating stage links 101 102, and 103 can conform to the shape of a given structure 11 without leaving any appreciable gaps or trip hazards, providing a safe and stable staging system for building work and repair.

Figure 4:
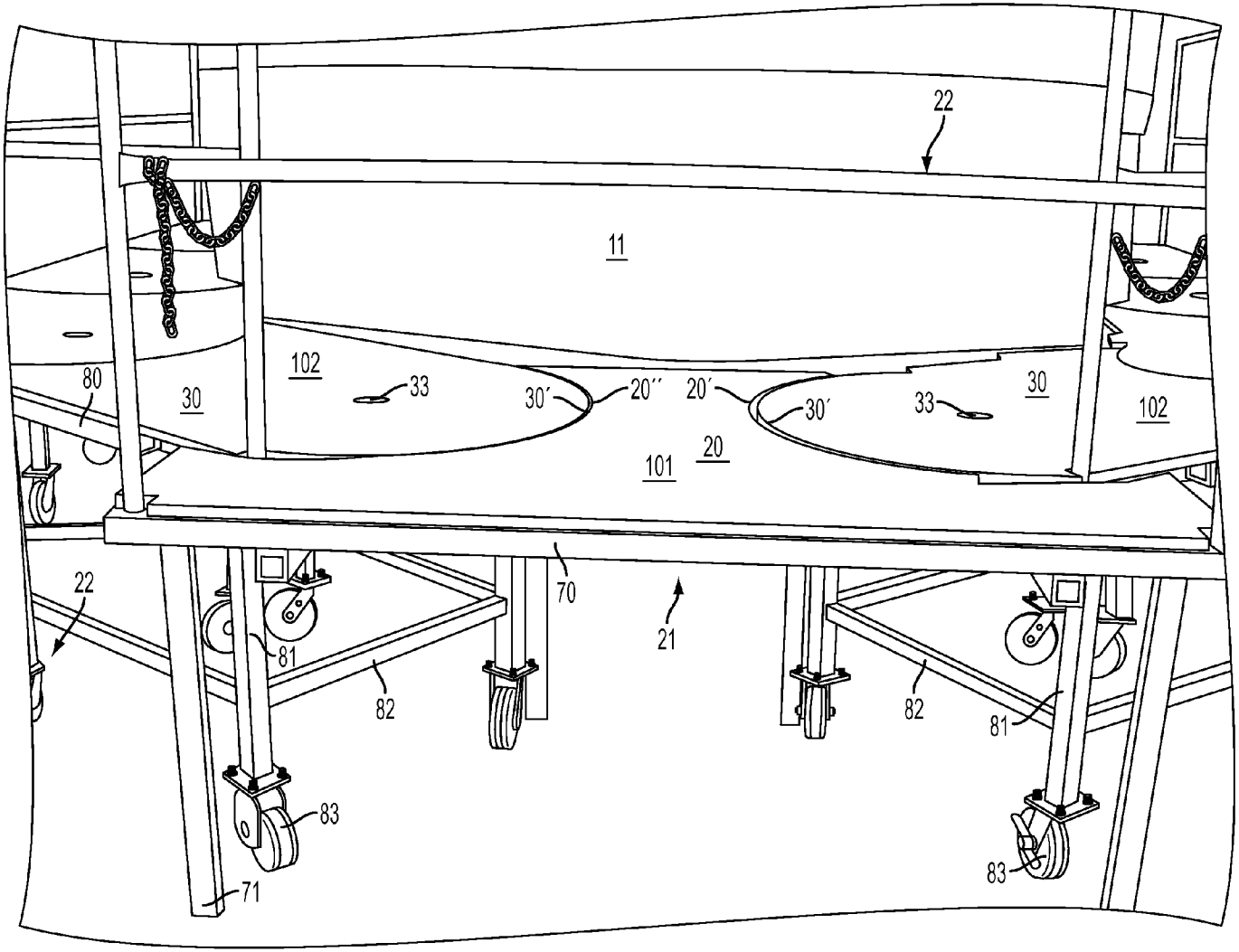
FIG. 4 is an end view of one embodiment of the staging system of the present invention showing the central stage link interfaced with opposing intermediate stage links.

FIG. 4 is an end view of one embodiment of the staging system 10 of the present invention. Shown here are the various components of the support frames for the stage links 101 and 102 as well as a partial view of the manner in which intermediate stage link 102 interfaces with center stage link 101. As shown, center stage link 101 includes a support frame 21 which comprises a horizontal platform support 70 supported by a plurality of support frame legs 71. The horizontal platform support 70 is configured to statically support platform 20 thereon and is additionally configured to support safety rail 22 vertically extending upward from the horizontal platform support 70. Here support frame legs 71 extend downward from horizontal platform support 70 and are fixed at the bottom.

Intermediate stage link 102 includes a support frame 31 which comprises a horizontal platform support 80 supported by a plurality of support frame legs 81. The support frame legs 81 may be interconnected by stretchers 82 extending between adjacent support frame legs 81. In some embodiments, the support frame legs 81 extend downward from the platform support 80 and include casters 83 such that intermediate stage links 102 can be easily moved into desired position and articulated with respect to one another as well as with respect to stage link 101. In some embodiments casters 83 are lockable such that intermediate stage legs 102 can be locked into position as desired. From here can also be seen how to intermediate stage links 102 are interfaced with center stage link 101 on other either end thereof by the engagement of the convex ends 30' of each intermediate stage link 102 with the concave ends of center stage link 101. Accordingly center stage link 101 provides the fixed central base for the staging system from which the articulating intermediate stage legs 102 disperse from around the structure 11.

Figure 5:
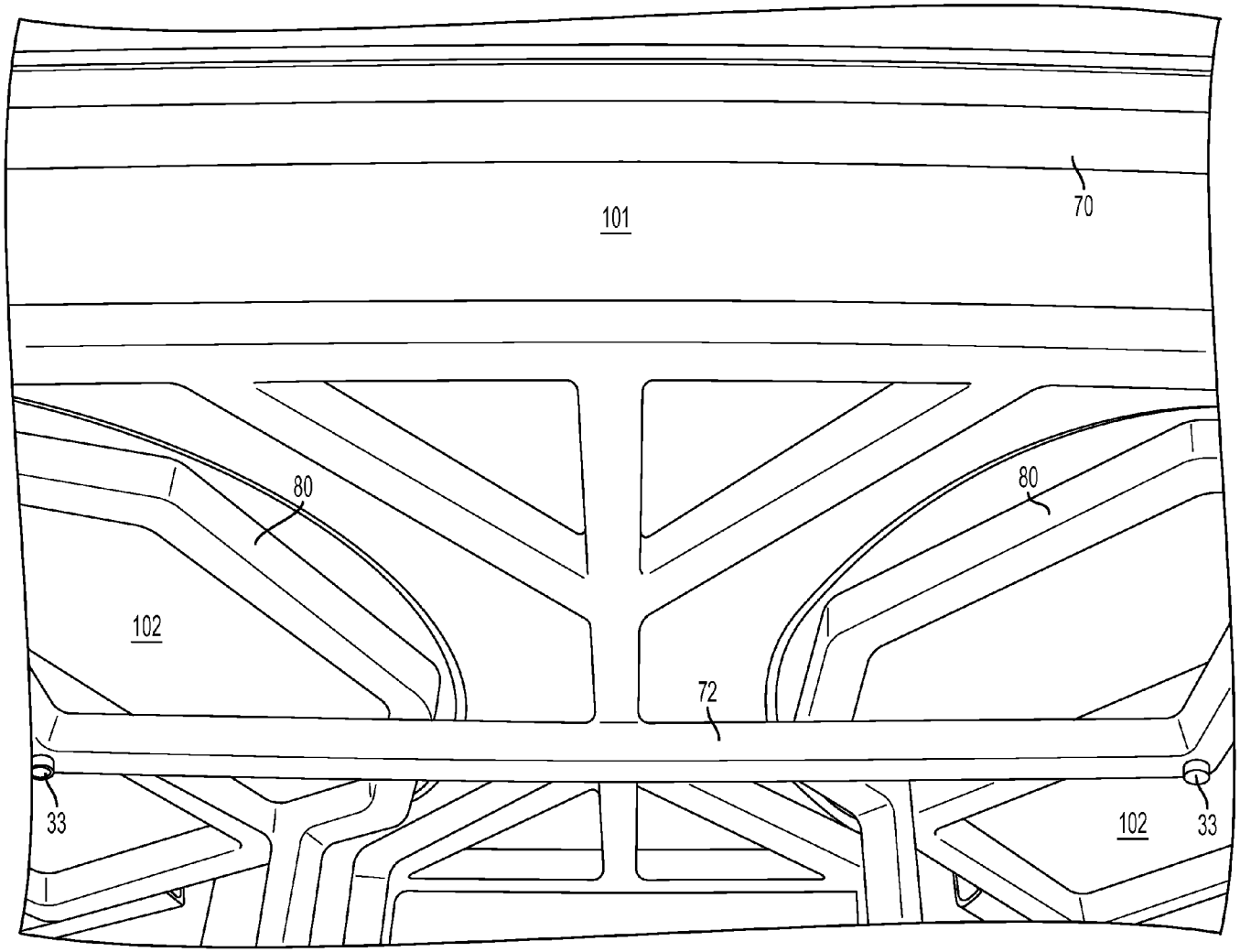
FIG. 5 is an underneath view of one embodiment of the staging system of the present invention showing the central stage link interfaced with opposing intermediate stage links.

FIG. 5 shows the underside of center stage link 101 and the interfacing thereof with intermediate stage links 102. Extending below horizontal platform support 70 of center stage link 101 is an undercarriage frame 72. The horizontal platform support 80 of intermediate stage links 102 is configured to interface with undercarriage frame 72 such that platform support 80 is disposed above undercarriage frame 72 providing that intermediate stage link 102 attaches to and interfaces with stage link 101. Here can also be shown how intermediate stage link 102 is pivotably attached to undercarriage frame 72 at rotation axis 33. This permits the intermediate stage links 102 articulate and rotate about rotation axis 33 such that the staging system can conform to the shape and size of a given structure. The support frames 31 of the respective intermediate stage links 102 may be attached to support frame 21 of center stage link 101 at rotation axis 33 by a pin or other suitable pivoting attachment.

Figure 6:
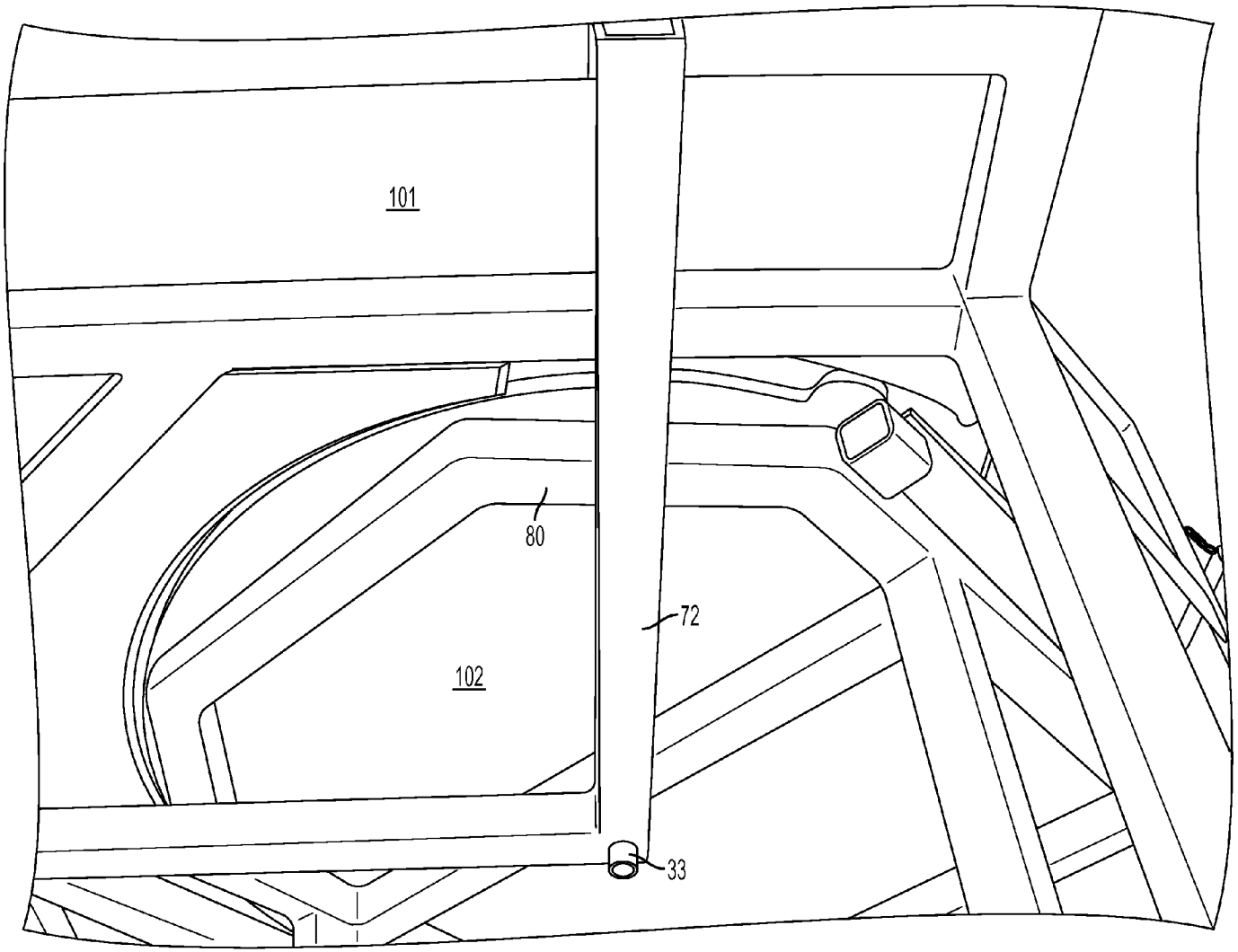
FIG. 6 is an additional underneath view of one embodiment of the staging system of the present invention showing the interface and attachment configuration of an intermediate stage link with a central stage link.

FIG. 6 is a close-up view of the attachment of intermediate stage link 102 to the underside of center stage link 101 at rotation axis 33. From here can be seen how the engagement of convex end 30' of intermediate stage link 102 with the concave end 20' of center stage link 101 allows for a large degree of rotation of intermediate stage link 102 about pivot axis 33 with respect to center stage link 101. This relatively large range of motion permits the staging system 10 to readily and easily articulate to conform to a variety of structures having a variety of shapes and sizes. This facilitates the configuration of a safe and stable working platform for building, assembly, and repair work.

Figure 7:
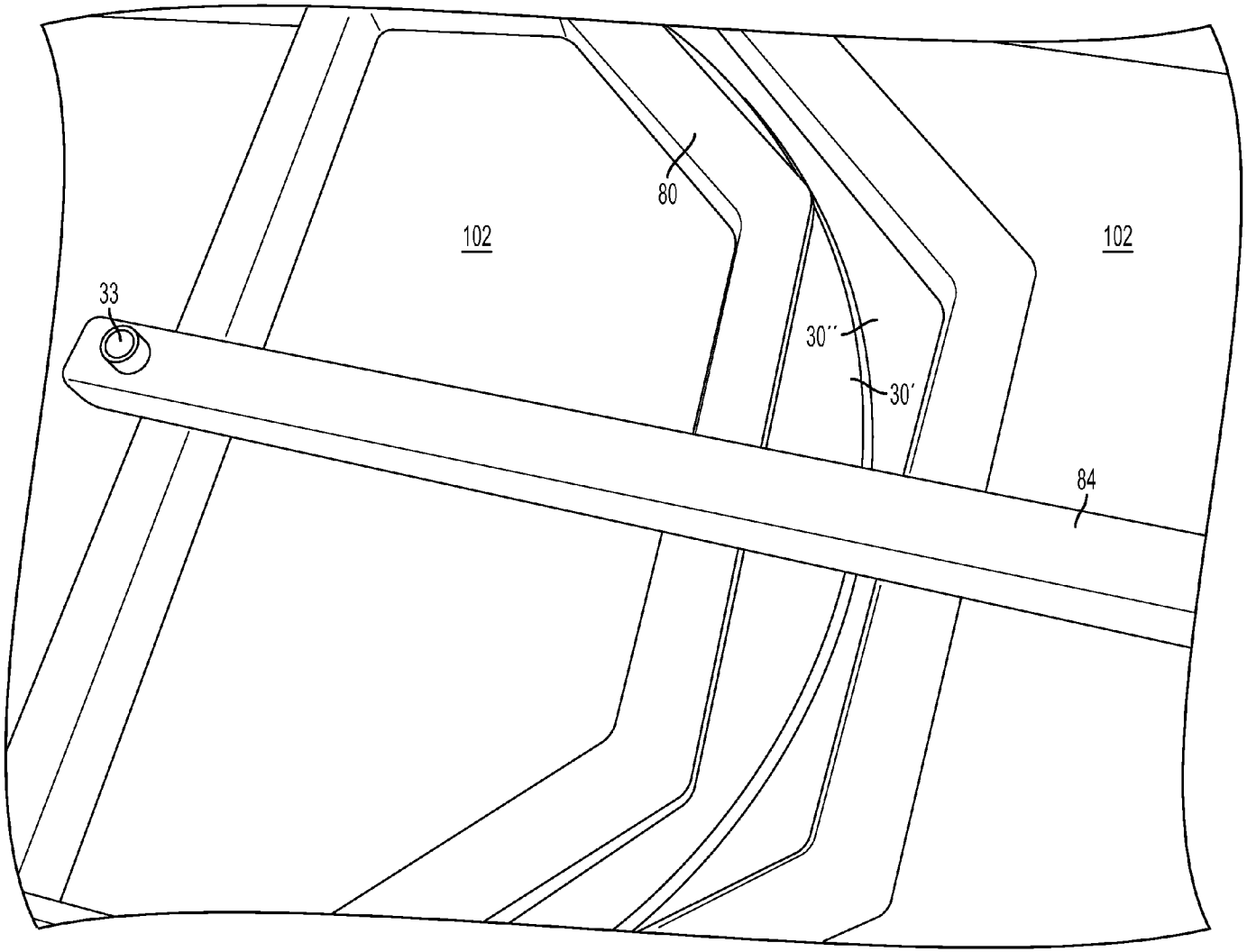
FIG. 7 is an underneath view of one embodiment of the staging system of the present invention showing the interface and attachment configuration of one intermediate stage link with an adjacent intermediate stage link.

As shown in FIG. 7, in some embodiments also included as part of the support frame 31 of intermediate stage links 102 is an undercarriage frame extension 84 that permits successive and adjacent intermediate stage links 102 to be pivotably attached to one another much in the same fashion as intermediate stage links 102 interface and pivotably engage center stage link 101. In some embodiments, undercarriage frame extension 84 extends downward from horizontal platform support 80 and outward towards concave end 30" of intermediate stage link 102 such that an adjacent intermediate stage link 102 at convex end 30' interfaces with and is pivotably attached to undercarriage frame extension 84 at rotation axis 33. Here it is shown that horizontal platform support 80 of an intermediate stage link 102 is received above the undercarriage frame extension 84 of the adjacent intermediate stage link 102. The support frames 31 of the respective intermediate stage links 102 may be attached at rotation axis 33 by a pin or other suitable pivoting attachment. It is appreciated and understood that end stage link 103 interfaces and attaches pivotably to an intermediate stage link 102 much in the same fashion as to adjacent intermediate stage links 102 attach as shown in FIG. 7. The primary difference with end stage link 103 is the presence of the substantially straight and 40" which need not include an undercarriage frame or other means by which an additional stage link can be attached thereto. Accordingly end stage link 103 is particularly well-suited for use at the terminal ends of the staging system to provide a point of access to the staging system service by a ladder, stairs 90 (See FIG. 8), or other means.

Figure 8:
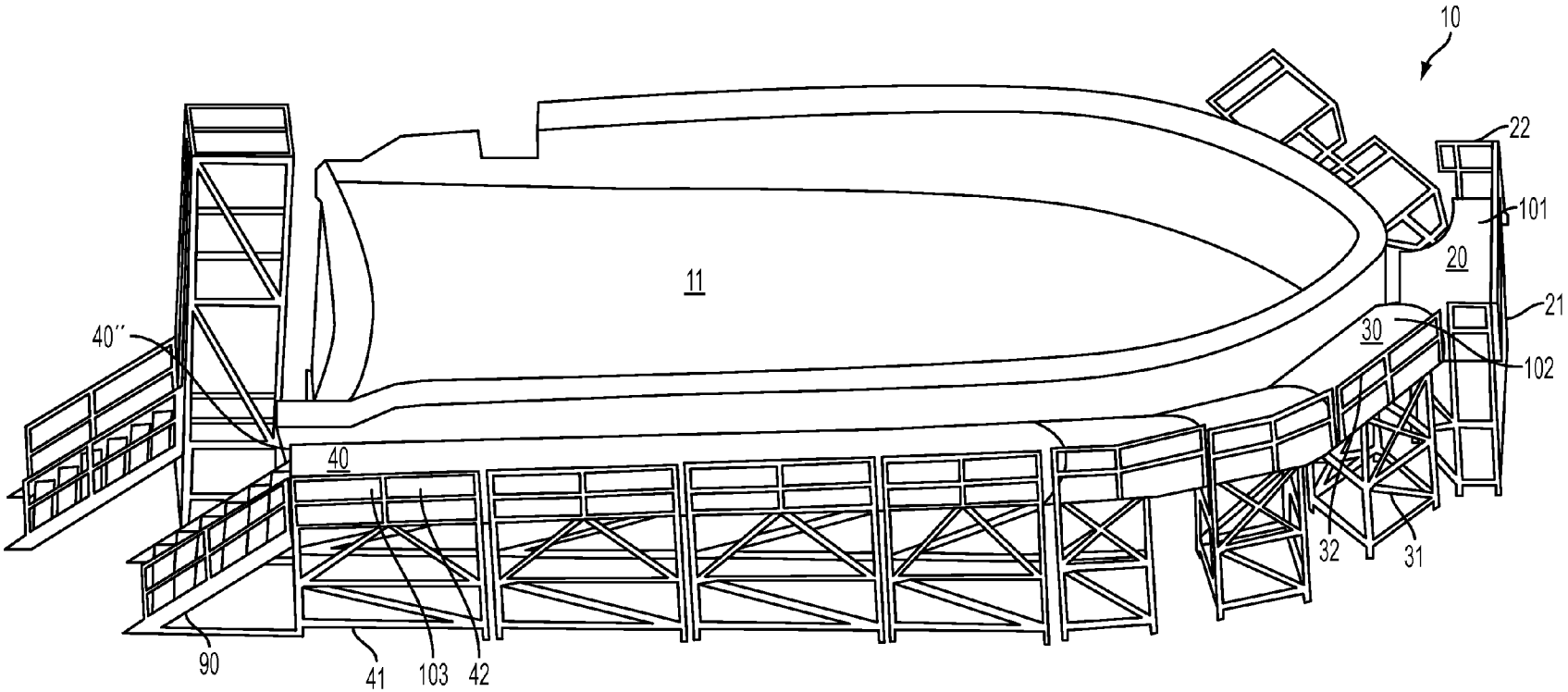
FIG. 8 is a side perspective view of one embodiment of the staging system of the present invention showing various additional features thereof.

FIG. 8 shows an embodiment of the staging system 10 from a side perspective view in use in connection with a structure 11 configured as a marine vessel. In light of the foregoing is appreciated and understood that the present invention provides articulating and configurable staging system comprising a plurality of interconnected and interfacing stage links. The provision of alternating convex and concave ends of the respective stage links provides for a substantially modular staging system that allows the user to increase and decrease the size of the staging system to accommodate a wide variety of structures by simply adding or removing stage links as appropriate. In some embodiments it is understood that the staging system should be built around at least one fixed center stage link 101 with the desired number of movable and articultable intermediate stage links 102 interfaced therewith. It is further appreciated that the provision of end stage links 103 is optional depending on the configuration of the staging system. For example, as shown in FIG. 1 and FIG. 8, if work is to be only done toward the end of a given structure 11 the staging system 10 need only partially surround the structure 11. Accordingly, end stage links 103 can be provided at the terminal ends of the staging system and, along with an access means such as a ladder or stairs 90 (FIG. 8), the end stage links 103 provide a safe and stable access point to the entire staging system 10.

It is appreciated and understood that the dimensions of the stage individual stage link can vary depending on the desired application. For example the use of a higher quantity of smaller stage links may allow the staging system to accommodate more intricate geometry than otherwise would larger and less numerous stage links.

While specific embodiments have been described in detail in the foregoing detailed description and illustrated in the accompanying drawings, those with ordinary skill in the art will appreciate that various modifications and alternatives to those details could be developed in light of the overall teaching of the disclosure. Accordingly, the particular arrangements disclosed are meant to be illustrative only and not limiting as to the scope of the invention, which is to be given the full breadth of the appended claims in any and all equivalents thereof.

What is claimed is:

1. A staging system comprising a plurality of interconnected unitary stage links, said stage links comprising: a center stage link and a plurality of intermediate stage links; wherein said stage links are each configured to articulate with respect to an adjacent one of said stage links such to position said staging system as desired, said center stage link having laterally opposing concave ends;

each one of said intermediate stage links of said plurality of interconnected unitary stage links includes a convex end and an opposing concave end, said convex end configured to interface with said concave end of an adjacent one of said intermediate stage links or one of said concave ends of said center stage links; and said plurality of interconnected unitary stage links forming a continuous staging system of directly connected stage links.

2. The staging system of claim 1, wherein said center stage link and said one or more intermediate stage links each include a platform supported by a support frame.

3. The staging system of claim 2, wherein said platform of said center stage link includes laterally opposing concave ends, each concave end configured to interface with one of said intermediate stage links.

4. The staging system of claim 3, wherein said platform of each of said one or more intermediate stage links includes said convex end and said opposing concave end, said convex end configured to interface with one of said opposing concave ends of said center stage link.

5. The staging system of claim 4, wherein said convex ends of said one or more intermediate stage links interface a respective said concave end of said center stage link at a rotation axis.

6. The staging system of claim 4, wherein said support frame of said one or more intermediate stage links includes a platform support, wherein said platform support is disposed above an undercarriage frame of said support frame of said central stage link.

7. The staging system of claim 4, wherein said support frames each include a plurality of support frame legs.

8. The staging system of claim 4, wherein each of said central stage link and said one or more intermediate stage links include a safety rail.

9. A staging system comprising:

A plurality of unitary stage links; said stage links comprising:

a center stage link and a plurality of intermediate stage links;

said center stage link and said intermediate stage links each including a platform supported by a support frame;

each one of said stage links being interconnected to an adjacent one of said stage links;

said platform of said center stage link having laterally opposing concave ends;

said platform of each of said intermediate stage links having a convex end and an opposing concave end;

wherein said convex ends of said intermediate stage links are configured to interface with one of said opposing concave ends of said center stage link or one of said opposing concave ends of an adjacent said intermediate stage link; and wherein said intermediate stage links are each configured to articulate with respect to said center stage link and one another such to position said staging system as desired.

10. The staging system of claim 9, wherein said central stage link is fixed and said plurality of intermediate stage links are moveable.

11. The staging system of claim 9, wherein said central stage link and said intermediate stage links each include a safety rail.

12. The staging system of claim 11, wherein said safety rail is removably attached to said support frame.

13. The staging system of claim 9, wherein said intermediate stage links are attached to one another or to said central stage link at a rotation axis about which said intermediate stage links articulate.

14. The staging system of claim 9, wherein said support frame of said intermediate stage links includes a platform support, wherein, when interfaced with said central stage link, said platform support is disposed above an undercarriage frame of said support frame of said central stage link.

15. The staging system of claim 9, wherein said support frame of said intermediate stage links includes a platform support, wherein, when interfaced with an adjacent said intermediate stage link, said platform support is disposed above an undercarriage frame extension of said support frame of said adjacent intermediate stage link.

16. The staging system of claim 9, further comprising one or more end stage links configured to interface in articulating fashion with one of said intermediate stage links.

17. The staging system of claim 9, wherein said support frame comprises a horizontal platform support and a plurality of support frame legs extending therefrom.

* * * * *